US009085884B2

(12) United States Patent
Lopchinsky

(10) Patent No.: US 9,085,884 B2
(45) Date of Patent: Jul. 21, 2015

(54) HINGED SINK COVER ASSEMBLY

(76) Inventor: Richard Lopchinsky, Phoenix, AZ (US)

( * ) Notice: Subject to any disclaimer, the term of this patent is extended or adjusted under 35 U.S.C. 154(b) by 1580 days.

(21) Appl. No.: 12/466,582

(22) Filed: May 15, 2009

(65) Prior Publication Data

US 2010/0287696 A1 Nov. 18, 2010

(51) Int. Cl.

| | |
|---|---|
| ***E03C 1/244*** | (2006.01) |
| ***B21D 39/03*** | (2006.01) |
| ***E03C 1/186*** | (2006.01) |

(52) U.S. Cl.

CPC ..... *E03C 1/186* (2013.01); *Y10T 29/49826* (2015.01)

(58) Field of Classification Search

USPC ..... 4/578.1–579, 635–640, 631, 654–658; 108/42; 220/212, 525, 810, 845, 848; D23/290

See application file for complete search history.

(56) References Cited

U.S. PATENT DOCUMENTS

| | | | | |
|---|---|---|---|---|
| 597,529 | A | 1/1898 | Schultz | |
| 1,275,695 | A * | 8/1918 | Iverson | 220/525 |
| 1,982,117 | A | 11/1934 | Murie | |
| 2,194,343 | A | 3/1940 | Wexler | |
| 2,308,123 | A | 1/1943 | Stein | |
| 2,314,157 | A | 3/1943 | O'Brien | |
| 2,334,293 | A | 11/1943 | Stein | |
| 2,437,862 | A | 6/1949 | Clawsey | |
| 2,594,938 | A | 4/1952 | Leavitt | |
| 2,658,205 | A | 11/1953 | Bowden | |
| 2,663,392 | A | 12/1953 | Miller | |
| 3,625,162 | A | 12/1971 | Crew | |
| 3,993,376 | A | 11/1976 | Meidahl | |
| 4,040,693 | A | 8/1977 | Peterson et al. | |
| 4,082,391 | A | 4/1978 | Turner | |
| 4,305,166 | A | 12/1981 | Rose | |
| 5,244,271 | A | 9/1993 | Hackwood et al. | |
| 5,313,676 | A | 5/1994 | Wright | |
| 5,349,708 | A | 9/1994 | Lee | |
| 5,815,855 | A | 10/1998 | McKeehan et al. | |
| D415,661 | S | 10/1999 | Georgeovich | |
| 6,611,972 | B2 | 9/2003 | Underbrink et al. | |
| 6,836,910 | B2 | 1/2005 | Cawthon | |
| 6,883,881 | B2 | 4/2005 | Gauss | |
| 7,305,723 | B2 | 12/2007 | Fulka | |

* cited by examiner

*Primary Examiner* — Paul R Durand
*Assistant Examiner* — Christine Skubinna
(74) *Attorney, Agent, or Firm* — Cahill Glazer PLC

(57) ABSTRACT

A sink cover assembly to alternately designate various areas of a dual-basin sink. Cover panel flips on hinge axis generally centered on dual-basin sink to obstruct access to at least one of the basins. The invention includes a method of designating various areas of a dual-basin or multiple basin sink by first securing a base to the sink, hingedly attaching a cover panel, and applying a cover panel over a basin opening and alternately swinging panel to designate areas of the sink. Indicia are used to identify areas.

5 Claims, 2 Drawing Sheets

HINGED SINK COVER ASSEMBLY

BACKGROUND OF THE INVENTION

1. Field of the Invention

The present invention relates generally to kitchen sinks, and more particularly, to management of dual-basin kitchen sinks and related kitchen utensils.

2. Description of the Related Art

Modern kitchen sinks generally include a single rotatable faucet head positioned over a dual-basin sink. Each of the basins includes a drain at the bottom thereof. Often, one of such drains leads to a garbage disposal unit for grinding waste.

Dual-basin sinks generally provide increased capacity in comparison to single-basin sinks. In addition, dual basin sinks allow a user to do two different things at once. For instance, one basin can be used to soak "dirty" dishes in soapy water, while the second basin may be used to rinse such dishes with clean water. Alternately, one basin may be used to store "dirty" dishes for washing at a later time, while the other basin may be used to store recently washed dishes while they dry. In this case, one may occasionally forget which basin contains clean dishes, and which basin contain dirty dishes. As a further example, one of the basins might be used for storing dirty dishes, pots, and utensils that need to be washed, while the second basin might be used for food preparation.

Another advantage of the dual basin sink manifests itself in a halachically-observant Jewish home. According to Jewish dietary laws, one must refrain from eating and/or mixing meat products with dairy products. In addition, one must use separate dishes and utensils for cooking, serving, and eating meat products, on the one hand, and dairy products, on the other hand. A third, or neutral category of food products that contain neither meat nor dairy (so-called "pareve" foods) exists, and many observant households maintain separate utensils and serving ware for such items.

In a kitchen equipped with a dual-basin sink, one basin might be dedicated to receiving "milk/dairy" dishes and utensils, while the second basin might be dedicated to receiving "meat" dishes and utensils. The strict requirements of Jewish law require that the "meat" dishes not be washed in the "dairy" basin, and that the "dairy" dishes not be washed in the "meat" basin. At times, particularly when one is distracted, it may be difficult to remember which basin is for which purpose. Moreover, when well-meaning guests are invited in, and help in the kitchen, the potential for errors is increased.

Food preparation in the kitchen often requires the use of a cutting board for cutting or slicing fruits, vegetables, meats, and other food items. It is often advantageous to have such a cutting board, or other work surface, proximate to a sink so that portions of food items that are not to be eaten (cores, peels, etc.) can be easily disposed of.

Covers for covering sink basins are generally known in the art. For example, U.S. Pat. No. 2,194,343 to Wexler discloses a drainboard that may be disposed over a first or second basin of a dual-basin sink to drain water into the opposite basin. U.S. Pat. No. 2,334,293 to Stein discloses a reversible cover for use with a dual-basin sink and which includes pivot members at one edge of such cover to facilitate upward swinging movement of the lid. U.S. Pat. No. 4,305,166 discloses a pair of reversible sink covers that may be used to cover the basins of a dual-basin kitchen sink. U.S. Pat. No. 5,815,855 to McKeehan, et al. discloses a sink cover designed for double sinks; however, the cover disclosed by McKeehan either covers both basins or neither basin. U.S. Pat. No. 7,305,723 to Fulks discloses a dual-basin kitchen sink, as well as a utility board hinged to the sink for selectively covering one of the two basins. U.S. Pat. No. 6,883,881 to Gauss discloses a portable kitchen apparatus that includes a dual-basin sink, as well as support surfaces that may be used to partially cover one or both of such basins. U.S. Pat. No. 6,611,972 to Underbrink, et al. discloses various cover structures for sinks, and in some instances, such covers are pivotable. However, Underbrink does not disclose covers for use with dual basin sinks. U.S. Pat. No. 3,625,162 to Crew discloses a work supporting surface adapted to be mounted over the divider of a dual-basin sink; however, such work surface does not cover either of the basins of the dual-basin sink.

It is therefore an object of the present invention to assist a user of a dual-basin sink to maintain a separation of objects in one basin of the sink from objects in the second basin of the sink.

It is another object of the present invention to encourage a user of a dual basin skin to place items into a first basin at certain times, and to discourage a user from placing items within, or removing items from, a second basin during such times.

A further object of the present invention is to assist a user of a dual basin sink from confusing clean dishes with dirty dishes.

A still further object of the present invention is to assist a users of a dual basin sink in a Kosher kitchen in maintaining separate washing spaces for "meat" and "dairy" dishes and utensils.

It is yet another object of the present invention to provide a method for reminding a user of a dual-basin sink of the purposes assigned to the first and second basins.

A further object of the present invention is to provide a convenient cutting board, or other work surface, proximate a sink.

A still further object of the present invention is to provide an apparatus which achieves the aforementioned objects and which can be manufactured inexpensively, and which is easy to use.

These and other objects of the present invention will become more apparent to those skilled in the art as the description of the present invention proceeds.

SUMMARY OF THE INVENTION

Briefly described, and in accordance with a preferred embodiment thereof, the present invention is a sink cover assembly for use with a dual-basin kitchen sink of the type which includes two adjoining basins divided from each other by a dividing wall. The sink cover assembly includes a base, or bracket, to fit over and around the dividing wall, and preferably has an elongated, inverted U-shape that generally follows the contour of the dividing wall. The dividing wall includes a top edge, and the base preferably engages the top edge of the dividing wall. A cover panel is hingedly coupled to the base for allowing the cover panel to alternate between a first position covering the first basin and a second position covering the second basin. The base may be permanently affixed to the dividing wall, if desired, but is preferably detachably mounted over the dividing wall to allow removal as necessary.

The hinged coupling between the base and the cover panel is preferably formed by a hinge having at least one a pivot axis extending substantially parallel to the dividing wall. The hinge may be either a simple single hinge or a double-acting hinge. The hinge permits the sink cover panel to move relative to the base, and to swing about the hinge pivot axis between a first position covering one basin and a second position covering the other basin.

The aforementioned base is preferably in the form of a bracket that includes an upper central portion and a pair of downwardly depending portions that are spaced apart from each other. A spacing member may be secured to the upper central portion of the bracket, if desired, to space the hinge above the bracket; this may allow the cover panel to more easily lie flat. In this instance, the aforementioned hinge may be attached to the spacing member.

In one preferred embodiment, the cover panel is generally planar, and includes first and second opposing surfaces; preferably, at least one of such surfaces bears indicia indicating a designated use for the basin that is currently exposed for use. The uppermost surface of such panel may also be used as a cutting board, if desired.

Another aspect of the present invention relates to a method of alternately covering one of two side-by-side basins of a dual-basin sink. The dual basin sink includes a dividing wall separating the first and second adjoining basins. A bracket, or base, is placed over the aforementioned dividing wall of the dual-basin sink. A sink cover is hingedly coupled to the bracket for allowing the sink cover to alternately cover the first basin or the second basin. The sink cover is preferably positioned over the opening of the first basin to at least partially obstruct access to the first basin when the second basin is in use; alternatively, the sink cover is positioned over the opening of the second basin to at least partially obstruct access to the second basin when the first basin is in use. Preferably, the aforementioned method includes the step of pivoting the sink cover about a pivot axis that extends substantially parallel to the dividing wall of the dual basin sink.

If desired, the aforementioned method may include the further step of coupling a spacing member to the bracket. In this instance, the method preferably includes the step of attaching a hinge to both the bracket and the spacing member.

Preferably, the method of the present invention also includes the step of applying a label or other indicia to at least one of the first and second opposing sides of the sink cover to remind the user of the purpose of the exposed basin of the sink.

BRIEF DESCRIPTION OF THE DRAWINGS

The present invention may more readily be understood by reference to the accompanying drawings in which.

DETAILED DESCRIPTION OF THE PREFERRED EMBODIMENTS

Figure 1:
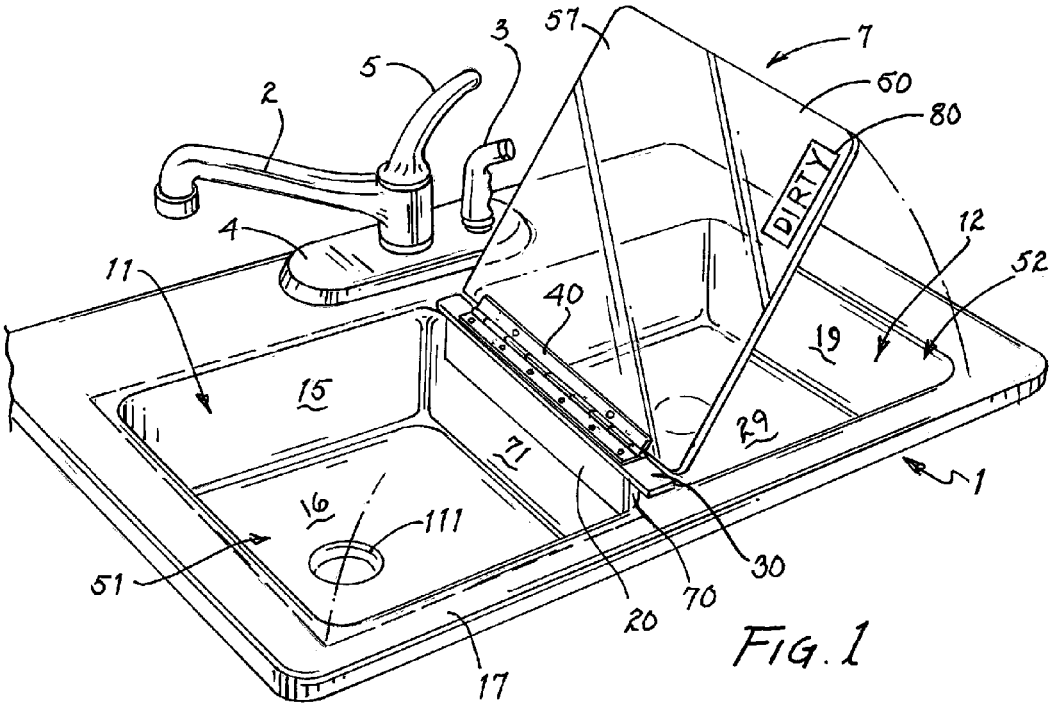
FIG. 1 is a perspective view of a dual-basin sink equipped with a sink cover assembly in accordance with a preferred embodiment of the present invention.
Figure 2:
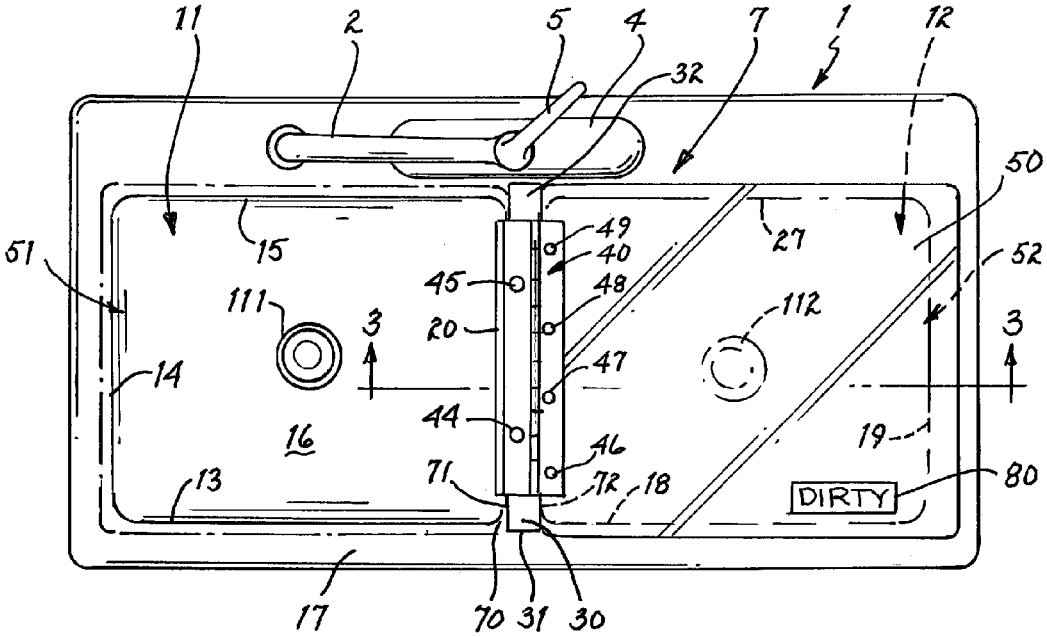
FIG. 2 is a top view of the dual-basin sink and sink cover assembly that are shown in FIG. 1.
Figure 3:
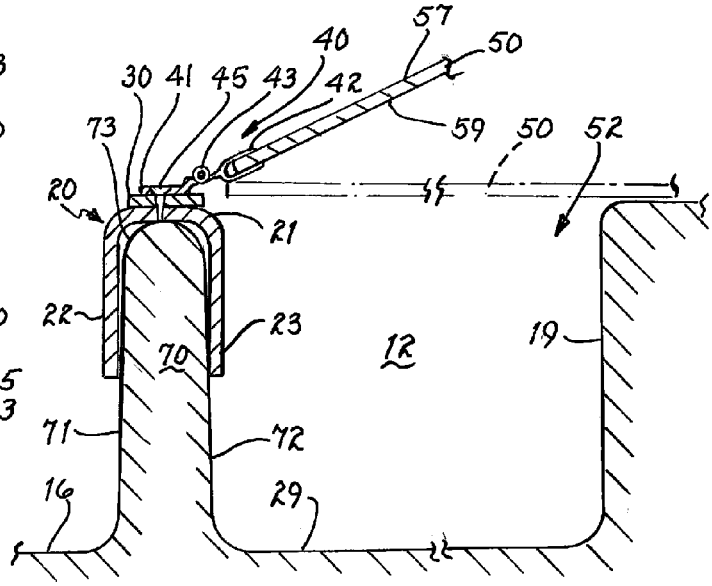
FIG. 3 is a cross-sectional view taken along line 3-3 in FIG. 2.
Figure 5:
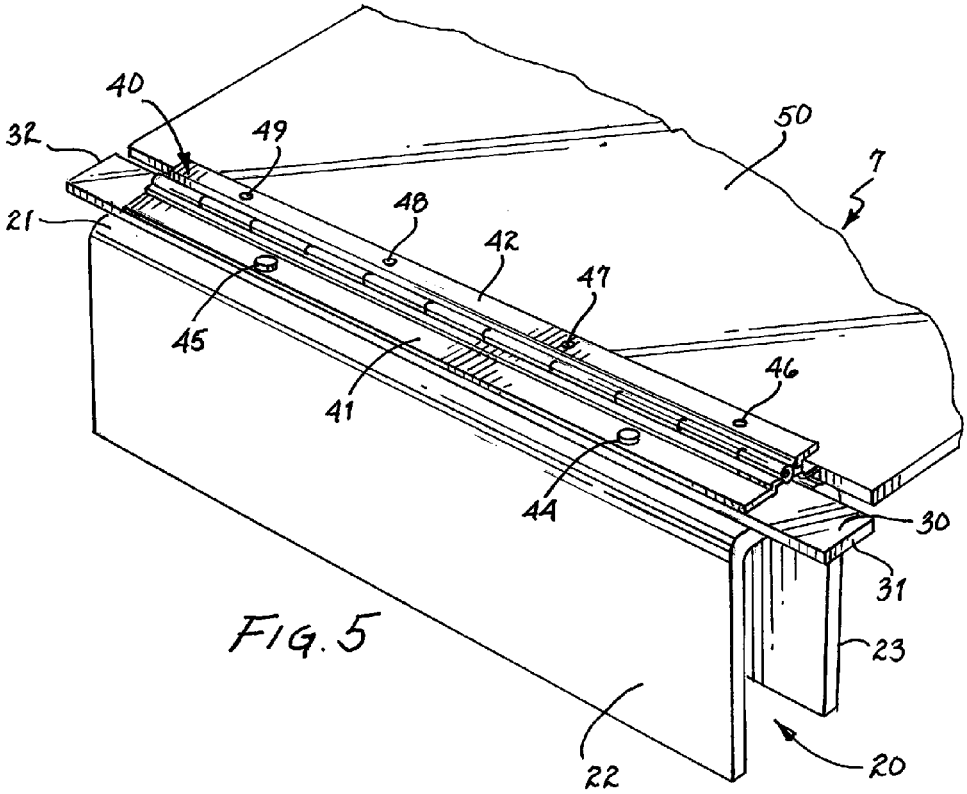
FIG. 5 is an enlarged partial perspective view of the sink cover assembly.

Referring to FIGS. 1-3, a dual-basin sink, of the type often found in a conventional kitchen, is designated generally by reference numeral 1. Dual-basin sink 1 includes a first basin 11 having a generally rectangular opening 51 surrounded by basin rim 17. First basin 11 includes a frontmost wall 13, a side wall 14, a rearmost wall 15, and a first side 71 of dividing wall 70. First basin 11 also includes a bottom wall 16 having a drain opening 111.

Similarly, dual-basin sink 1 includes a second basin 12 having a generally rectangular opening 52 surrounded by basin rim 17. Second basin 12 includes a frontmost wall 18, a side wall 19, a rearmost wall 27, and a second side 72 of dividing wall 70. Second basin 12 also includes a bottom wall 29 having a drain opening 112. Dividing wall 70 thus serves to divide the adjoining first and second basins 11 and 12 from each other.

As noted above, rim 17 surrounds first basin 11 and second basin 12, and also aids in mounting dual-sink basin 1 upon a counter top or cabinet. A faucet assembly 4 is secured to the rear side of rim 17, and includes a swivel faucet 2 with a controlling handle 5, along with an optional sprayer 3. Faucet assembly 4 is preferably mounted centrally behind two basins 11 and 12 for allowing water to be directed into either basin. Dividing wall 70 separates first basin 11 from second basin 12, and includes an upper rounded edge portion 73.

Referring to FIGS. 1-3 and 5, sink cover assembly 7 includes a base in the form of a bracket 20. Bracket 20 is adapted to be engaged over and around dividing wall 70 of dual-basin sink 1 for mounting sink cover assembly 7 thereto. In the preferred embodiment, bracket 20 has a generally elongated inverted U-shape, and includes a central upper portion 21 and opposing downwardly-extending portions 22 and 23 spaced from each other. Central upper portion 21 is adapted to overlie and engage rounded upper edge 73 of dividing wall 70. Downwardly-extending portions 22 and 23 extend down along sides 71 and 72, respectively, of dividing wall 70. Preferably, bracket 20 is detachably mounted over and around dividing wall 70 to allow for convenient removal, if desired. In the preferred embodiment, the space between the inner faces of portions 22 and 23 is approximately 4.5 centimeters to allow for a snug fit over dividing wall 70; this separation width may be varied to suit different styles of sinks. Alternatively, the space between the inner faces of portions 22 and 23 can be made larger than the typical sink dividing wall, and spacers (not shown) of various widths may be secured to the inner faces of portions 22 and 23 of bracket 20 to permit bracket 20 to snugly fit over sink dividing walls of varying thicknesses. In the preferred embodiment, downwardly-extending portions 22 and 23 extend roughly 6 to 8 centimeters below central upper portion 21.

In the preferred embodiment, a spacing member 30 is secured to central upper portion 21 of bracket 20, just above central upper portion 21. Spacing member 30 extends from front end 31 to opposing rear end 32.

Still referring to FIGS. 1-3 and 5, sink cover assembly 7 includes a generally planar sink cover panel 50 hingedly connected to bracket 20 for allowing cover panel 50 to rotate between a first position covering first basin 12, or a second position covering second basin 11. A hinge 40 includes a first hinge plate 41 secured to spacing member 30 by screws 44 and 45. Spacing member 30 elevates hinge 40 slightly above bracket 20 and allows cover panel 50 to lie flat whether cover panel 50 is in its first position covering first basin 12, or in its second position covering second basin 11. Flat head screws 44 and 45 extend through both spacing member 30 and base 20, thereby securing spacing member 30 and base 20. The lower ends of screws 44 and 45 may threadedly engage tapped holes formed in spacing member 30 and base 20; alternatively, the lower ends of screws 44 and 45 may be engaged by nuts disposed on the underside of bracket 20. While screws 44 and 45 may be used to fasten spacing member 30 to bracket 20, it is also possible to secure spacing member 30 to bracket 20 independently of screws 44 and 45, as by welding, adhesives, etc.

Hinge 40 also includes a second hinge plate 42 which is pivotally attached to first hinge plate 41 by hinge pin 43. As shown best in FIG. 3, second hinge plate 42 may have a C-shaped clip cross-section for slidingly receiving a side edge of cover panel 50. Second hinge plate 42 of hinge 40 is secured by fasteners 46, 47, 48 and 49 to a side edge of cover panel 50. Hinge 40 allows cover panel 50 to swing about an axis coincident with hinge pin 43 substantially parallel to upper edge 73 of dividing wall 70. Hinge 40 may be in the form of a basic butt hinge, but is preferably provided in the form of an elongated piano hinge (also known as a "continuous hinge") with numerous sections/links. Fasteners 44 and 45, used to secure hinge 40 to bracket 20, and fasteners 46, 47, 48 and 49, used to secure hinge 40 to cover panel 50, can be longitudinally offset from each other, so that a fastener for one hinge plate does not directly coincide with a fastener for the other hinge plate when the hinge plates are folded over themselves, thereby avoiding any obstruction to the swinging action of the assembly.

In FIG. 2, cover panel 50 is shown in a first position overlying basin 12. In this position, cover panel 50 serves to block off opening 52 to basin 12, and thus obstructs access to second basin 12. Alternatively, cover panel 50 may be lifted from such first position (as shown in FIGS. 1 and 3), and swung along a pivot axis (coincident with hinge pin 43) to a second position (not shown) overlying basin 11 to block off opening 51, thereby obstructing access to basin 11.

Referring to FIGS. 1-3, indicia 80 may be placed on one, or both, of opposing surfaces 57 and 59 of cover panel 50 to designate and distinguish one basin from the other basin. For instance, surface 57 may be emblazoned with the legend "DIRTY", while opposing surface 59 may be emblazoned with the legend "CLEAN". Thereby, when cover panel 50 is in its position overlying basin 12, as shown in FIG. 2, indicia 80 on applied to surface 57 of cover panel 50 will remind a user that the contents of basin 12 (lying below cover panel 50) are "dirty". In contrast, when cover panel 50 is swung to overlie basin 11, the legend "CLEAN" is displayed from surface 59 of cover panel to remind a user that the contents of basin 11 (lying below cover panel 50) are "clean". Alternatively, for purposes of a Kosher kitchen, surface 57 of cover panel 50 might be labeled "MEAT", and surface 59 of cover panel 50 might be labeled "DAIRY", to designate basins 12 and 11, respectively, as being for either dishes and utensils used for "meat" meals, or dishes and utensils used for "dairy" meals.

When cover panel 50 is in its first position overlying basin 12, then surface 57 of cover panel 50 may be used as a cutting board or other work surface in conjunction with basin 11. On the other hand, when cover panel 50 is in its second position overlying basin 11, then surface 59 of cover panel 50 may likewise be used as a cutting board or other work surface in conjunction with basin 12.

It may also be advantageous to maintaining cover panel 50 at a slight downward angle directed toward the pivot axis (i.e., hinge pin 43) for causing any fluid deposited upon the sink cover panel (50) to drain toward such pivot axis. In other words, when cover panel 50 overlies basin 12, it is preferred that the edge of cover panel 50 that lies farthest from hinge 40 is slightly elevated as compared with the opposing edge of cover panel 50 that is adjacent hinge 40; this allows any water or other material that falls upon surface 57 of cover panel 50 to drain back toward hinge 40 and into the exposed basin 11. Likewise, when cover panel 50 overlies basin 11, it is again preferred that the edge of cover panel 50 that lies farthest from hinge 40 is slightly elevated as compared with the opposing edge of cover panel 50 that is adjacent hinge 40; this allows any water or other material that falls upon the surface 59 of cover panel 50 to drain back toward hinge 40 and into the exposed basin 12. In this manner, when cover panel 50 is overlying dishes in basin 12 that have been cleaned, splashing of dirty water from basin 11 onto cover panel 50 is drained away from, rather than into, basin 12. Alternatively, when cover panel 50 is overlying dairy dishes in basin 11, and meat is being cut on surface 59 of cover panel 50, meat juices will drain back toward basin 12, rather than into basin 11. In some cases, it may be necessary to secure one or more spacers, or standoffs (not shown), at the remote (relative to hinge 40) corners of cover panel 50 to elevate such corners above basin rim 17 to achieve this result.

In the preferred embodiment, bracket 20, spacing member 30, and cover panel 50 are all made of a hard, clear plastic material, for example, the acrylic sheet material commercially available under the trademark Plexiglas® (generally mis-spelled as Plexiglass), a registered trademark of the Atoglas company, formerly Rohm & Haas. Base 20, spacing member 30, and cover panel 50 are preferably about 5 millimeters thick. Hinge 40, and fasteners 44, 45, 46, 47, 48 and 49 are preferably made of stainless steel to resist corrosion.

Figure 4A:
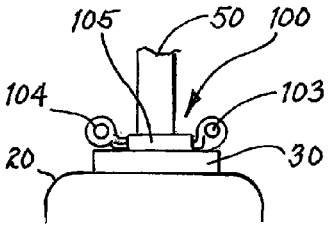
FIGS. 4A and 4B illustrate an alternate embodiment of the invention wherein a double-acting hinge is used to couple a sink cover panel to the underlying base and spacing members.
Figure 4B:
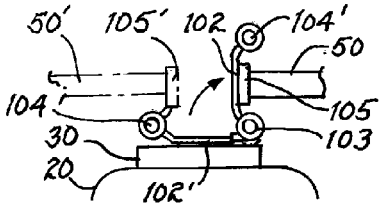

Referring to FIGS. 4A and 4B, an alternate embodiment of the sink cover assembly is shown in schematic form, wherein double-acting hinge 100 replaces the single-acting hinge 40 of the previously-described embodiment for the purpose of hingedly mounting cover panel 50 to spacing 30 and bracket 20. Double-acting hinge 100 includes a hinge plate 105 secured to sink cover panel 50. In FIG. 4A, sink cover panel 50 is shown directed vertically, midway between its first position covering basin 12 and its second position covering basin 11. In this position, hinge pins 103 and 104 both lie proximate to spacing member 30.

Referring to FIG. 4B, hinge plate 105 is pivotally coupled by a movable hinge pin 104 to an intermediate hinge plate 102. A third, fixed hinge plate (not shown) has been omitted from FIGS. 4A and 4B for the sake of clarity; this third hinge plate is fixedly attached to spacing member 30. The side of intermediate hinge plate 102 opposite from hinge pin 104 is engaged by a non-movable hinge pin 103 that remains in place relative to spacing member 30. Hinge pin 103 facilitates swinging movement of cover panel 50 toward the basin on the right side of the sink (i.e., basin 12). When cover panel 50 is swung to the right, hinge plate 105 overlies hinge plate 102, and pivot pin 104 rotates upward to position 104' in FIG. 4B. Hinge pin 104 facilitates swinging movement of cover panel 50 toward the basin on the left side (basin 11); in FIG. 4B, this position is indicated by reference numeral 50'. In this instance, hinge plate 105 moves to the position designated as 105' in FIG. 4B, and extends perpendicular to intermediate hinge plate 102.

Another aspect of the present invention relates to an improved method of covering one of two separate basins (11/12) of a dual-basin sink (1) of the type having a dividing wall (70) that separates the first and second adjoining basins (11/12). In practicing such method, a base or bracket (2) is placed over the dividing wall (70), and a sink cover panel (50) is hingedly coupled (via 40) to the bracket (20) for allowing the sink cover panel (50) to alternately cover the first basin (11) and the second basin (12). Preferably, such method pivots the sink cover panel (50) about a pivot axis (see hinge pin 43) that extends substantially parallel to the dividing wall (70). The sink cover panel (50) is placed over an opening (51/52) of one of the first and second basins (11/12) to obstruct access to the underlying basin. Ideally, the method includes coupling a spacing member (30) thereto, as well as the attachment of a hinge (40) to both the bracket (20) and the spacing member (30). Further, in practicing such method, indicia are preferably applied to at least one of the opposing surfaces (57/59) of the sink cover panel (50) for reminding the user of an intended purpose of the exposed basin (or, alternatively, an intended purpose of the covered basin). The improved method may also include the step of maintaining the sink cover panel (50) at a slight downward angle directed toward the pivot axis (i.e., hinge pin 43) for causing any fluid deposited upon the sink cover panel (50) to drain toward the pivot axis.

Those skilled in the art will now appreciate that a sink cover assembly has been described which assists a user of a dual-basin sink to easily maintain a separation of items in one basin from items in the other basin. The disclosed device serves to remind a user to place items into a first basin at certain times, and to discourage the user from placing items within, or removing items from, a second basin during such times. The sink cover assembly can also serve to assist a user from confusing clean dishes in one basin with dirty dishes in the other basin, or otherwise remind the user of the purposes assigned to the first and second basins. The disclosed device can also be used to help observant Jews in maintaining a Kosher kitchen by in distinguishing separate washing spaces for "meat" and "dairy" dishes and utensils. In addition, the sink cover assembly also provides a convenient cutting board and/or work surface. In addition, it will be appreciated that the disclosed sink cover assembly is easy to use, and can be manufactured inexpensively.

While the present invention has been described with respect to a preferred embodiment thereof, such description is for illustrative purposes only, and is not to be construed as limiting the scope of the invention. Various modifications and changes may be made to the described embodiments by those skilled in the art without departing from the true spirit and scope of the invention as defined by the appended claims.

What is claimed is:

1. A sink cover assembly for use with a dual-basin kitchen sink having first and second adjoining basins divided from each other by a dividing wall, said assembly comprising:

an inverted U-shaped bracket being engaged over the dividing wall, said bracket including an upper central portion and a pair of downwardly depending portions spaced from each other;

a spacing member secured to said upper central portion of said bracket;

a hinge coupled to said spacing member; and a sink cover panel attached to said hinge and movable relative to said base.

2. The sink cover assembly of claim 1 wherein said sink cover panel is hingedly coupled to said base to swing along a pivot axis extending substantially parallel to the dividing wall.

3. The sink cover assembly of claim 1 wherein said bracket is detachably secured to the dividing wall.

4. The sink cover assembly of claim 1 wherein said hinge is a double acting hinge.

5. The sink cover assembly of claim 1 wherein said sink cover panel is generally planar, comprising first and second opposing surfaces, at least one of said first and second surfaces bearing indicia.

* * * * *